US009802138B2

(12) United States Patent
Weiss

(10) Patent No.: US 9,802,138 B2
(45) Date of Patent: Oct. 31, 2017

(54) MULTI-DIRECTIONAL STACKABLE BLOCK

(71) Applicant: DRINK BLOCKS, LLC, Ladera Ranch, CA (US)

(72) Inventor: Tom Weiss, Ladera Ranch, CA (US)

( * ) Notice: Subject to any disclaimer, the term of this patent is extended or adjusted under 35 U.S.C. 154(b) by 0 days.

(21) Appl. No.: 15/335,973

(22) Filed: Oct. 27, 2016

(65) Prior Publication Data

US 2017/0043272 A1 Feb. 16, 2017

Related U.S. Application Data

(63) Continuation of application No. 29/473,138, filed on Nov. 19, 2013, now Pat. No. Des. 718,394, and a continuation of application No. 29/473,136, filed on Nov. 19, 2013, now Pat. No. Des. 718,393, and a continuation-in-part of application No. 14/244,568, filed on Apr. 3, 2014, now Pat. No. 9,480,932, which is a continuation-in-part of application No. 29/454,696, filed on May 13, 2013, now Pat. No. Des. 716,669, and a continuation-in-part of application No. 29/473,132, filed on Nov. 19, 2013, now Pat. No. Des. 718,392, and a continuation-in-part of application No. 29/471,736, filed on Nov. 4, 2013, now Pat. No. Des. 715,161, and a continuation-in-part of application No. 29/471,733, filed on Nov. 4, 2013, now Pat. No. Des. 714,163, and a continuation-in-part (Continued)

(51) Int. Cl.

| | |
|---|---|
| ***A63H 33/08*** | (2006.01) |
| ***A63H 33/00*** | (2006.01) |
| ***B65D 81/36*** | (2006.01) |
| ***A63H 33/06*** | (2006.01) |

(52) U.S. Cl.

CPC ..... *A63H 33/086* (2013.01); *A63H 33/003* (2013.01); *A63H 33/062* (2013.01); *A63H 33/082* (2013.01); *B65D 81/361* (2013.01)

(58) Field of Classification Search

CPC ..... A63H 33/086

USPC ..... 206/511, 503, 504, 508; 220/23.83, 220/23.86, 23.6

See application file for complete search history.

(56) References Cited

U.S. PATENT DOCUMENTS

| | | | |
|---|---|---|---|
| 1,245,440 | A | 11/1917 | Converse |
| 2,923,551 | A | 2/1960 | Pope |

(Continued)

FOREIGN PATENT DOCUMENTS

| | | |
|---|---|---|
| DE | 102004047830 | 3/2006 |
| WO | WO2006084453 | 8/2006 |

*Primary Examiner* — Aarti B Berdichevsky
*Assistant Examiner* — Rayshun Peng

(57) ABSTRACT

A stackable block is provided which may be constructed as a traditional toy or as a beverage container. The block includes six sides. Furthermore, the block includes at least one projection which projects from one of the block's sides. Each projection is square so as to include a face and four sidewalls. Furthermore, it is preferred that each projection include a ridge forming a recess between the square projection's face and a block's side. Furthermore, each block includes at least one slot formed into one of the block's sides. This slot extends the entire side of a block and forms an elongate cavity sized for receipt of a projection. Preferably, each slot includes parallel opposed flanges sized to project into a projection's recesses.

4 Claims, 8 Drawing Sheets

Related U.S. Application Data of application No. 29/471,730, filed on Nov. 4, 2013, now Pat. No. Des. 715,160, and a continuation-in-part of application No. 29/468,953, filed on Oct. 4, 2013, now Pat. No. Des. 715,159, and a continuation-in-part of application No. 29/457,668, filed on Jun. 12, 2013, now Pat. No. Des. 716,152.

(60) Provisional application No. 61/835,908, filed on Jun. 17, 2013.

(56) References Cited

U.S. PATENT DOCUMENTS

| | | | | |
|---|---|---|---|---|
| 4,035,947 | A | 7/1977 | Burge | |
| 4,202,131 | A | 5/1980 | Poleri | |
| 4,308,955 | A | 1/1982 | Schieser et al. | |
| 4,656,840 | A | 4/1987 | Loofbourrow et al. | |
| 5,381,916 | A * | 1/1995 | Strawder | B65D 21/0202 220/212 |
| 5,782,358 | A | 7/1998 | Walker | |
| 5,832,687 | A | 11/1998 | Willemsen | |
| 5,853,314 | A | 12/1998 | Bora | |
| 5,890,595 | A | 4/1999 | Credle, Jr. | |
| D412,662 | S | 8/1999 | Giskeodegaard et al. | |
| 6,050,044 | A | 4/2000 | McIntosh | |
| D445,148 | S | 7/2001 | McIntosh | |
| D447,944 | S | 9/2001 | Justice | |
| 6,352,167 | B1 | 3/2002 | Yu | |
| 6,588,612 | B1 | 7/2003 | Dorn et al. | |
| 6,616,499 | B1 | 9/2003 | Sorensen | |
| 6,932,228 | B1 | 8/2005 | Darr et al. | |
| 7,152,752 | B2 | 12/2006 | Kurtenbach | |
| 7,175,498 | B2 * | 2/2007 | Garpow | A63H 33/08 446/117 |
| D546,401 | S | 7/2007 | Sorensen | |
| 7,644,828 | B1 | 1/2010 | Klein | |
| 8,201,699 | B2 | 6/2012 | Zummo et al. | |
| 2004/0102132 | A1 | 5/2004 | Miller et al. | |
| 2009/0090647 | A1 * | 4/2009 | Panchal | B65D 21/0204 206/504 |
| 2011/0204051 | A1 | 8/2011 | Pawl | |

* cited by examiner

MULTI-DIRECTIONAL STACKABLE BLOCK

RELATED APPLICATIONS

The present application is a continuation of co-pending U.S. application Ser. No. 14/244,568 filed Apr. 3, 2014, which in turn is a continuation-in-part of co-pending U.S. Design patent application Ser. No. 29/473,138 filed on Nov. 19, 2013, and a continuation-in-part of co-pending U.S. Design patent application Ser. No. 29/473,136 filed on Nov. 19, 2013, and a continuation-in-part of co-pending U.S. Design patent application Ser. No. 29/473,132 filed on Nov. 19, 2013, and a continuation-in-part of co-pending U.S. Design patent application Ser. No. 29/471,736 filed Nov. 4, 2013, and a continuation-in-part of co-pending U.S. Design patent application Ser. No. 29/471,733 filed Nov. 4, 2013, and a continuation-in-part of co-pending U.S. Design patent application Ser. No. 29/471,730 filed Nov. 4, 2013, and a continuation-in-part of co-pending U.S. Design patent application Ser. No. 29/468,953 filed on Oct. 4, 2013, and a continuation-in-part of co-pending U.S. Provisional Patent Application Ser. No. 61/835,908 filed on Jun. 17, 2013, and a continuation-in-part of co-pending U.S. Design patent application Ser. No. 29/457,668 filed Jun. 12, 2013, and a continuation-in-part of co-pending U.S. Design patent application Ser. No. 29/454,696 filed May 13, 2013.

BACKGROUND OF THE INVENTION

The present invention relates to stackable toys. In addition, the present invention relates to stackable bottles which permit bottles to be stacked on top of one another or affixed side by side. For purposes herein, stackable toys and stackable beverage bottles will be collectively referred to herein as "stackable blocks".

There are a large number of different toy building blocks in the prior art. Such toy blocks are known to have interlockable male and female features allowing the blocks to be connected to one another to create a wide variety of creative and playful configurations. Perhaps the most well-known brand for such interconnecting toys is the Lego® toy which are predominantly square or rectangular blocks which are built up in layers to form different shapes and structures. Most Lego® toys are six sided blocks including one or more studs protruding from one of the six sides. The Lego® toys typically include one or more receptacles on the opposite side of the studs which are configured to snugly receive the studs of mating blocks.

Of course, beverage containers are known for storing beverages. In addition, beverage containers, and primarily plastic beverage containers, are commonly used for arts and crafts. In addition, beverage containers have been designed to include projections and recesses for allowing the containers to be stacked in various fanciful manners so as to be played with by children. For example, U.S. Pat. No. 4,656,840 describes a stackable beverage container which has projections and recesses for allowing the containers to be affixed in various arrangements. Similarly, U.S. Pat. No. 7,175,498 describes a beverage container having round projections which fit into opposing slotted recesses. Moreover, the top threaded cap portion can affix into a recess in the bottom of the bottle. U.S. Pat. No. 8,201,699 illustrates a beverage bottle wherein the top threaded portion can be affixed into a bottom recess. In addition, the bottle has a flat side for fitting into a horizontal slot formed into the side of the bottle. The combination of the threaded top and round recess allows the bottles to be stacked, and the planar side and slot formed into the adjoining side allow the bottle to be arranged in various constructions.

Unfortunately, all of these blocks suffer from various drawbacks. Some of these blocks can be stacked, but only in limited arrangements. Other block designs are not aesthetically pleasing or are difficult to manufacture.

Therefore, it is a principal object of the present invention to provide an improved stackable block that can be constructed as a stackable toy or as a stackable beverage container.

It is a further object of the present invention to provide a stackable block which has pleasing aesthetic features.

It is still a further object of the present invention to provide a stackable block which can be readably stacked to provide a wide range of arrangements.

Further objects and advantages of the present invention will be apparent from the drawings and summary of the invention below.

SUMMARY OF THE INVENTION

In accordance with the invention, an improved stackable block for making block assemblies is provided. The block may be constructed as a traditional toy block for connecting similar blocks into layers for forming desired shapes and structures. Alternatively, the block may be constructed as a beverage container and therefore includes a central cavity for storing a beverage and an opening preferably sealed by a threaded cap.

The block has a body having six sides including substantially parallel front and back sides, substantially parallel left and right sides, and substantially parallel top and bottom sides. Each of these sides is preferably planar, but some curvature is also acceptable. Furthermore, the terms "front", "back", "left side", "right side", "top" and "bottom" are all being used for reference purposes, and a particular side of the block should not be considered to be so limited as being a front, back, left, right, top or bottom side.

The block of the present invention includes at least one projection which projects from one of the block's six sides. In certain preferred embodiments, at least two projections project from a side. Importantly, the projections are square to form four sidewalls and a face. Preferably, each square projection includes an outwardly extending ridge which forms a recess extending entirely around the square projection between the top of the square projection and the block's side.

The block of the present invention further includes at least one slot formed into one of the block's sides. The slot extends substantially the entire width of a side of the block. The slot forms a cavity, and preferably the slot includes parallel opposed flanges that extend over the cavity.

The blocks's square projection and ridge recess are sized to slide into a corresponding slot with the slot's flanges extending into the square projection's recess so as to prevent a projection from disengaging from a slot of other like stackable blocks. Moreover, the square configuration of the projection prevents relative rotation of a first stackable block to an affixed stackable block. In addition, the square shape of the projection allows one to fix similar stackable blocks together in a first position, but to then also disengage the blocks and rotate one of the bottles 90° while still allowing the projection to slide into a correspondingly sized slot to provide a second attachment position wherein the projection and block have been rotated 90° as compared to the first position. Again, once a projection has been locked within a corresponding slot with the slot's flanges residing within the projection's recess, the bottles are locked together and prevented from rotating relative to each other.

The block of the present invention can be provided in a wide variety of embodiments. In a first embodiment, a stackable block includes a first side having two projections, and a second side having two slots. The slots may be formed in a side adjacent to the projections, or formed into an opposing side. In another embodiment, two different sides include a pair of projections and two sides include a pair of slots. The two pairs of projections may project from adjacent sidewalls or in opposing sides. Similarly, the two pairs of slots may be positioned in adjacent sidewalls or opposing sides. In still an additional embodiment, the block is constructed as a toy (non-beverage container) wherein three sides include two or more projections, and the remaining three sides include a corresponding number of slots.

Advantageously, the block may be constructed as a beverage bottle. For these embodiments, it is preferred that the top include a male threaded inlet which can be closed by a female threaded cap. Meanwhile, the bottom of the block beverage container may include a square projection, a slot, or a circular recess sized for receiving either the opposing threaded inlet or threaded cap so that the stackable block beverage containers can be stacked upon one another.

Thus, it is an object of the present invention to provide an improved stackable block.

It is an additional object of the present invention to provide a stackable block that can be used as a toy or as a beverage container.

It is still an additional object of the present invention to provide a block which can stack to like blocks but prevent their relative rotation, while still allowing the blocks to be detached and then affixed to one another into a second position 90° relative to the first position.

These and other objects and advantages of the invention will be apparent to those skilled in the art from the following detailed description taken in conjunction with the drawings.

BRIEF DESCRIPTION OF THE DRAWINGS

Figure 1:
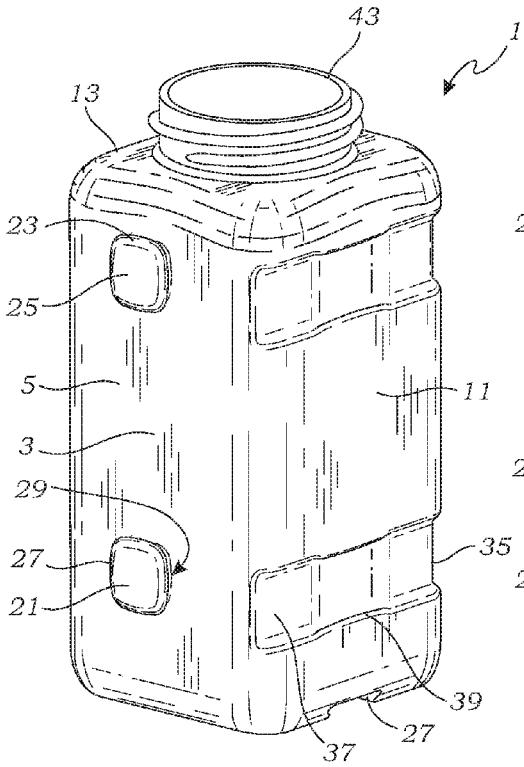
FIG. 1 is atop, right perspective view of a first embodiment of the stackable block of the present invention constructed to function as a beverage container containing two pairs of projections on opposing sidewalls and two pairs of slots on opposing sidewalls.
Figure 2:
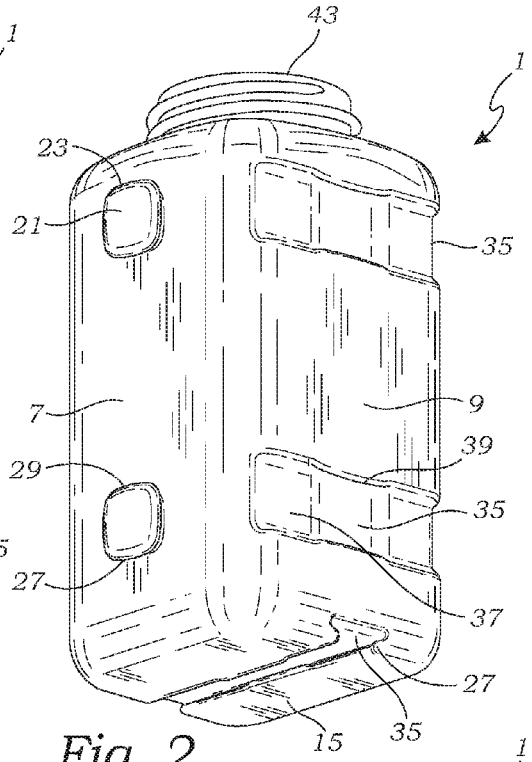
FIG. 2 is a bottom, rear perspective view of the stackable block illustrated in FIG. 1.
Figure 3:
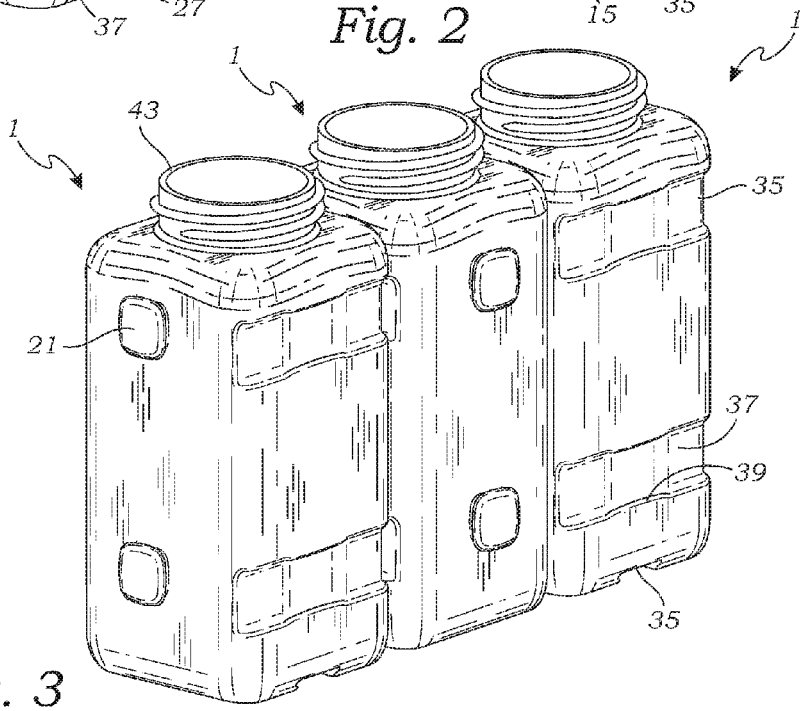
FIG. 3 is a top, right perspective view illustrating three stackable blocks of the type illustrated in FIGS. 1 and 2 stacked together.
Figure 4:
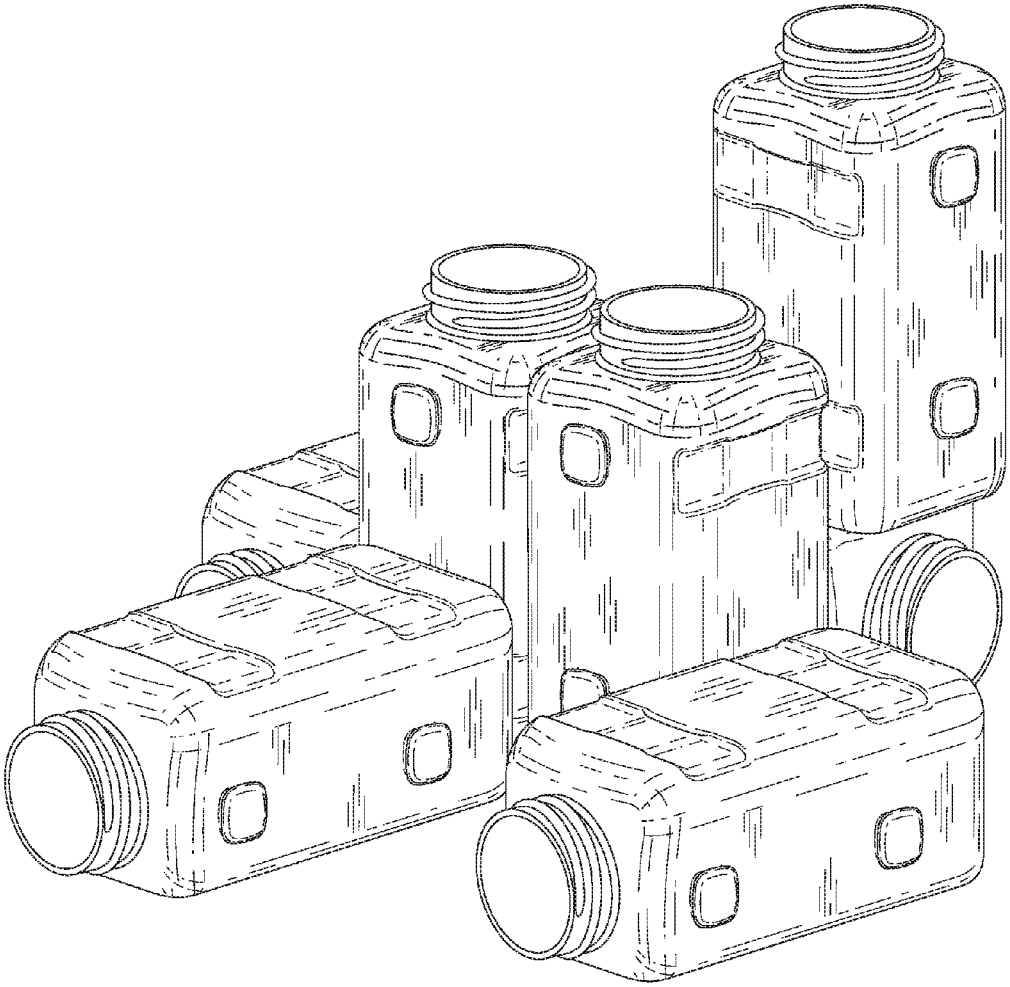
FIG. 4 is a top perspective view illustrating seven stackable blocks illustrated in FIGS. 1 and 2 stacked together.

While the present invention is susceptible of embodiment of various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to FIGS. 1-20, the stackable block 1 of the present invention includes six sides 3 including a front side 5, rear 7, left side 9, right side 11, top side 13 and a bottom side 15. The stackable block further includes at least one projection 21 projecting from one of the sides. As best illustrated in FIG. 7, each projection 21 has four sides referred to herein as sidewalls 23. Furthermore, each projection has a face 25 which is preferably planar and parallel to the block's nearby side. Preferably, each sidewall 23 has a region which extends to form an edge 27 and a recess 29 which extends entirely around the square projection between the projection's face 25 and the block's nearby side 3. The stackable block may include any number of projections 21 projecting from a block's side 3. However, as illustrated in the figures, it is preferred that a side includes two projections 21.

The block 1 of the present invention further includes at least one slot 35 formed into one of the block's sides 3. The slot 35 preferably extends the entire width or length of a block side. Furthermore, the slot forms an elongate cavity 37 sized to receive a projection 21. As illustrated in the figures including FIG. 7, preferably each slot includes opposed flanges 39 which extends inwardly and are formed towards the slot's middle to narrow the slots cavity 37.

As illustrated in FIG. 7, a stackable block square projection 21 is sized to slide into a similar block's slot 35. The slot's flanges 39 are sized to extend into the block's square projection recess 29. Preferably, the projection and slot are sized so as to provide a press-fit arrangement so as to prevent detachment of one block from another, but also to restrict rotation of one block relative to another when two blocks are mated.

Advantageously, the square shape of the projection 21 allows one to affix two stackable blocks together in a first position. Due to the projection's square profile and press-fit arrangement, the stackable blocks are locked together with their relative rotation limited. However, the blocks 1 can be disengaged by sliding a block and its projection from another block's slot. Thereafter, the block and its projection can be rotated 90° about the center of the projection. Once rotated, the projection 21 can once again be slid into the slot 35 of the similar block and lock into a second position. Once again as illustrated in FIGS. 3, 4, 7, 10, 13, 16, 19 and 20, the blocks are locked together due to the projection edges residing behind the slot flanges.

As illustrated in FIGS. 1-20, the interlocking blocks may be constructed in a wide variety of embodiments. For example, FIGS. 1-12 illustrate that the interlocking blocks can be constructed as beverage bottles. These embodiments include a top side 13 having a threaded inlet 43 for receiving a female threaded cap (not shown). For these embodiments, the interlocking block 1 is hollow to form a central chamber for accepting a liquid. Alternatively, as illustrate in FIGS. 13-20, the stackable blocks 1 may be constructed as traditional stackable toys which do not have an inlet for receiving and expelling a beverage. Instead of a threaded inlet, the block's top side 13 may include a slot. However, it is preferred that a toy block top include a projection 21 sized and formed for locking to a slot 35 formed into the block's bottom side 15.

In a first preferred embodiment illustrated in FIGS. 1-4, the stackable block 1 of the present invention includes a pair of projections 21 projecting from the blocks front side 5 and backside 7, and includes a pair of slots 35 formed into the block's left side 9 and right side 11. The block also includes a single slot formed into the block's bottom 15, and a threaded inlet 43 formed upon the block's top side for use as a beverage container.

Figure 5:
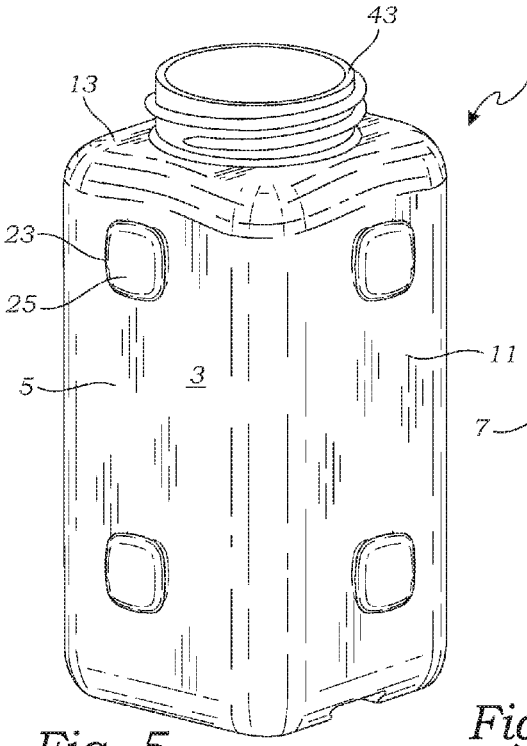
FIG. 5 is atop, right perspective view of a second embodiment of the stackable block of the present invention configured as a beverage container containing two pairs of projections on adjacent sidewalls and two pairs of slots on adjacent sidewalls.
Figure 6:
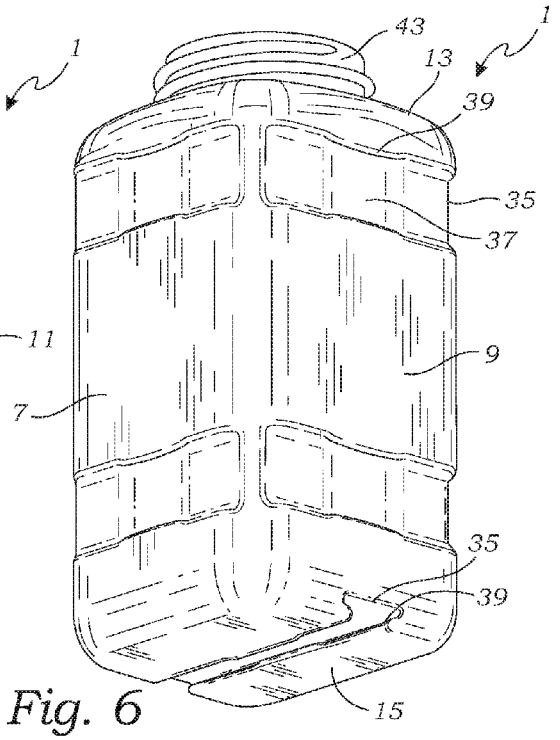
FIG. 6 is a bottom, rear perspective view of the stackable block illustrated in FIG. 5.
Figure 7:
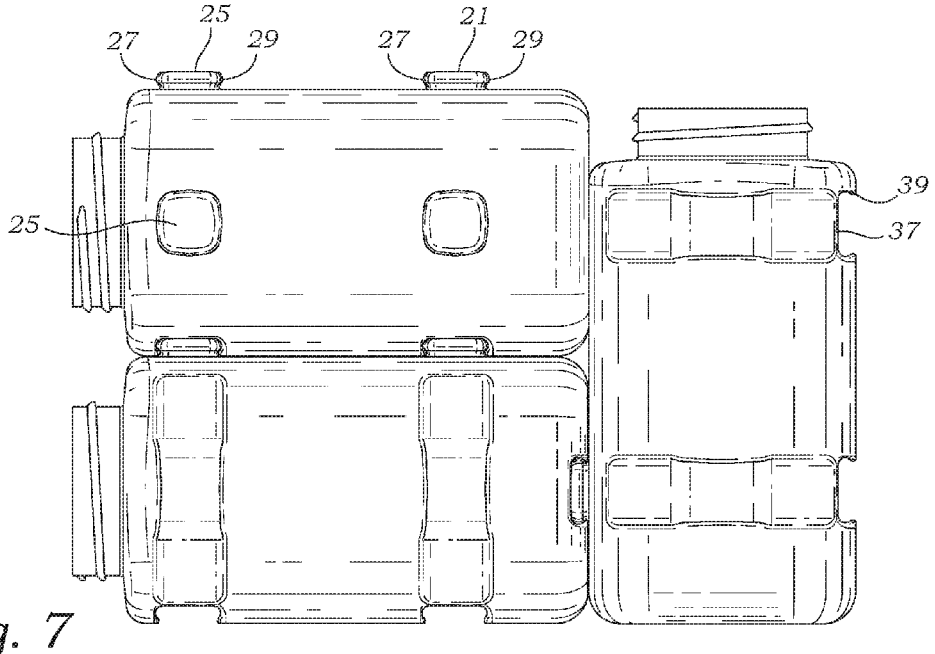
FIG. 7 is a side view illustrating three stackable blocks of the type illustrated in FIGS. 5 and 6 affixed together.
Figure 8:
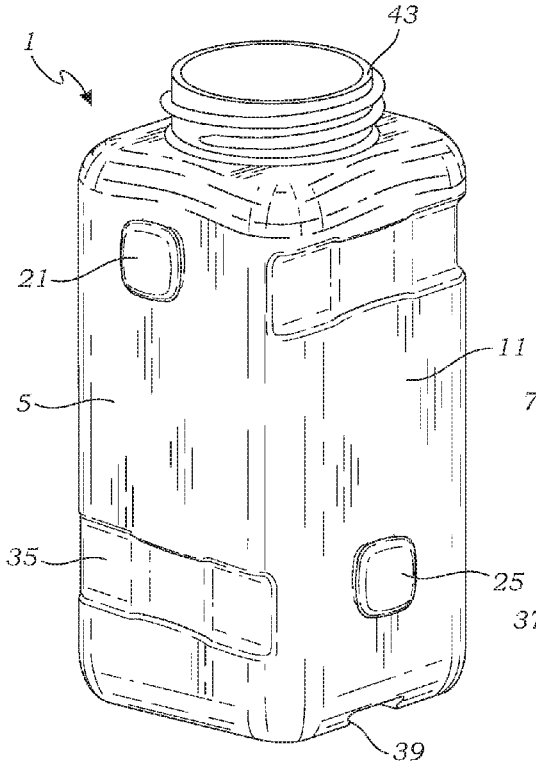
FIG. 8 is a front, top perspective view of a third embodiment of the stackable block of the present invention configured as a beverage container wherein four sides include a single projection and a single slot.
Figure 9:
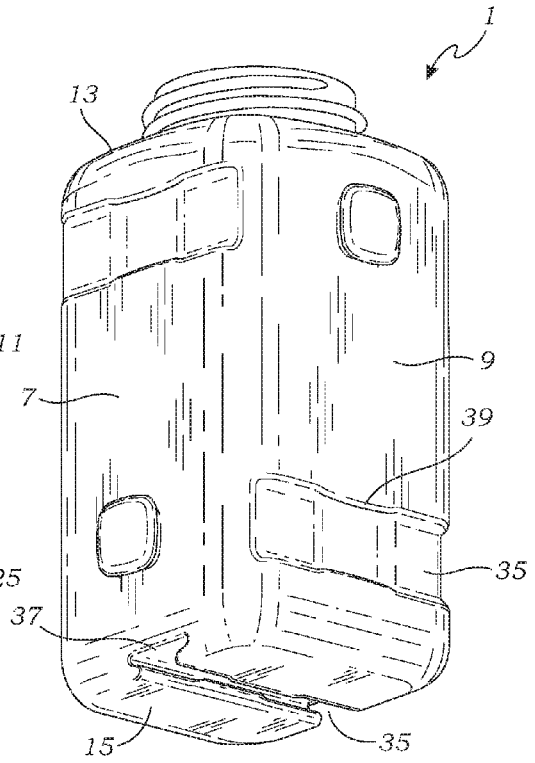
FIG. 9 is a bottom, rear perspective view of the stackable block illustrated in FIG. 8.
Figure 10:
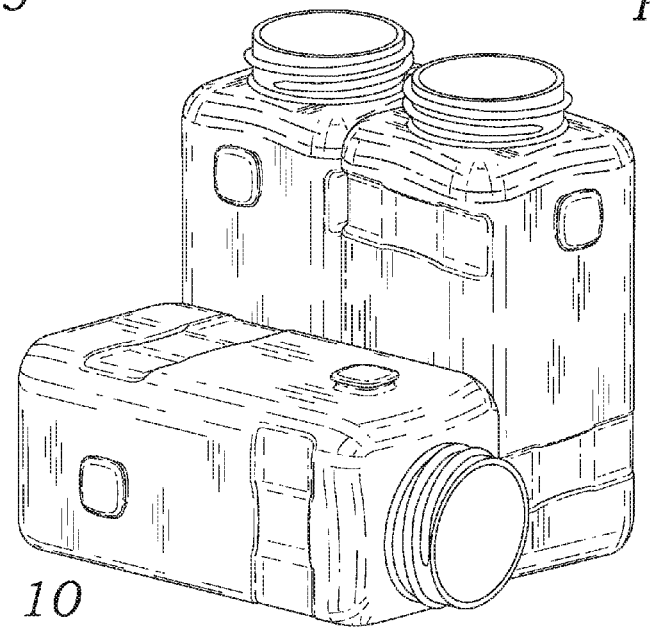
FIG. 10 is a perspective view illustrating three stackable blocks illustrated in FIGS. 8 and 9 stacked together.
Figure 11:
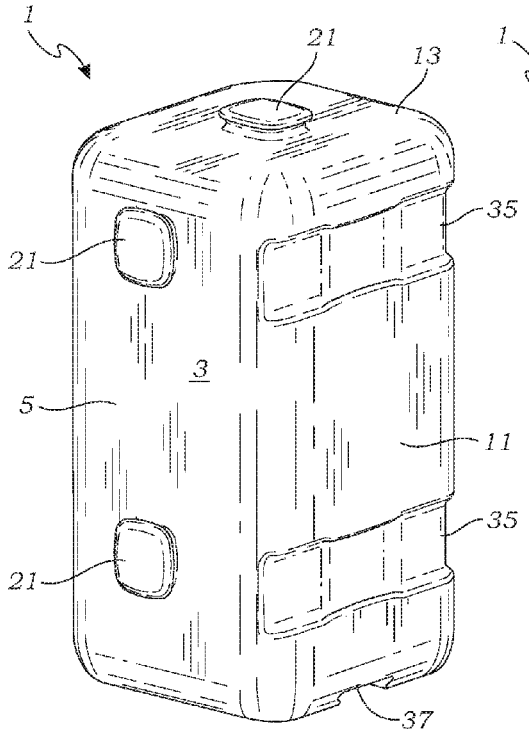
FIG. 11 is a fourth embodiment of the stackable block of the present invention configured as a toy having two pairs of projections extending from opposing sidewalls, two pairs of slots formed into opposing sidewalls, a single projection formed upon the top side, and a slot formed in the bottom side.
Figure 12:
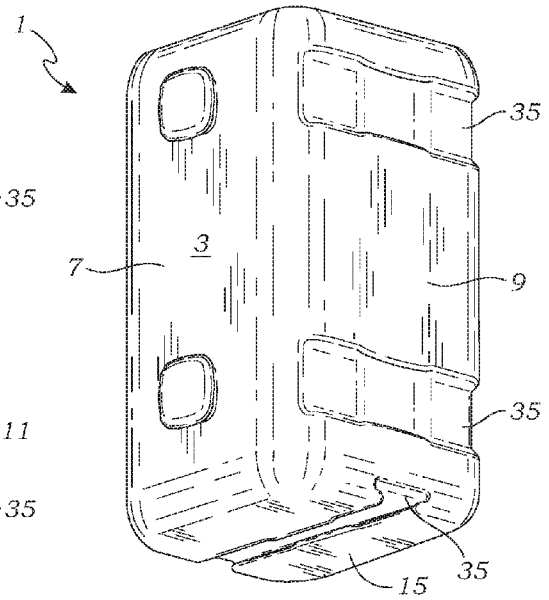
FIG. 12 is a bottom, rear perspective view of the stackable block illustrated in FIG. 11.
Figure 13:
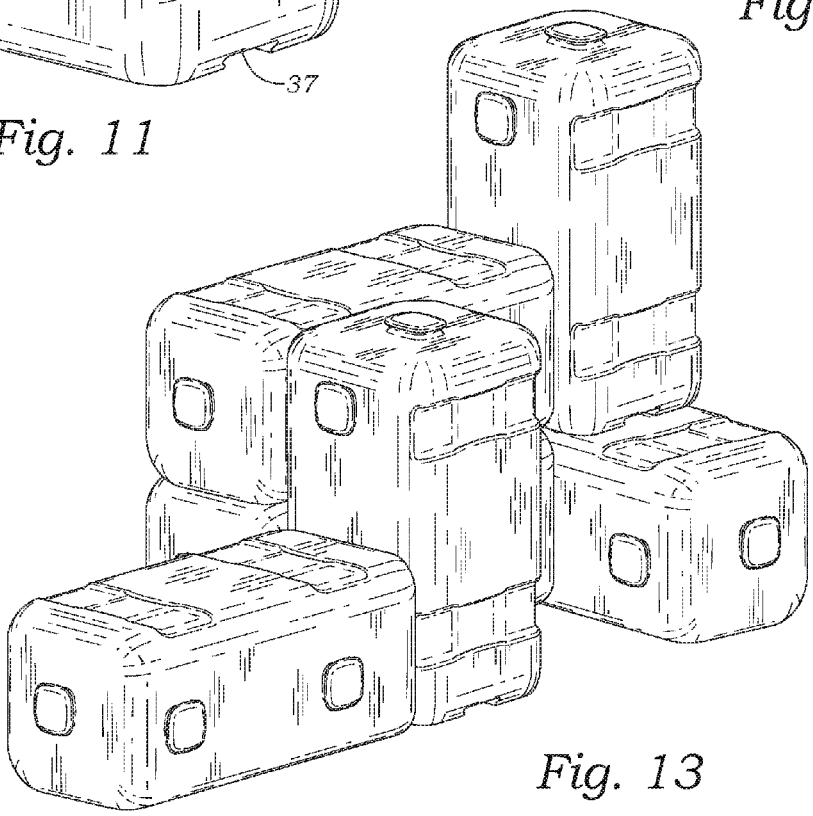
FIG. 13 is a perspective view illustrating six stackable blocks of the type illustrated in FIGS. 11 and 12 stacked together.

In an alternative embodiment illustrated in FIGS. 5-7, the stackable block 1 includes two pairs of projections formed into adjoining sides, which are illustrated as the front side and right side. The block includes two pairs of slots 35 illustrated as formed into the back side 7 and left side 9. The block further includes a single slot 35 formed into the block's bottom 15, and a threaded inlet 43 formed at the block's top 13. Still an additional stackable block for use as a beverage container is illustrated in FIGS. 8-10. In this embodiment, the front side 5, back side 7, left side 9, and right side 11 include a single projection 21 and single slot 35. However, whether the projection or slot is positioned closer to the block's top or bottom is alternated in adjacent sides. Again, the block's bottom 15 includes a single slot 35 and the block's top includes a threaded inlet 43.

Figure 14:
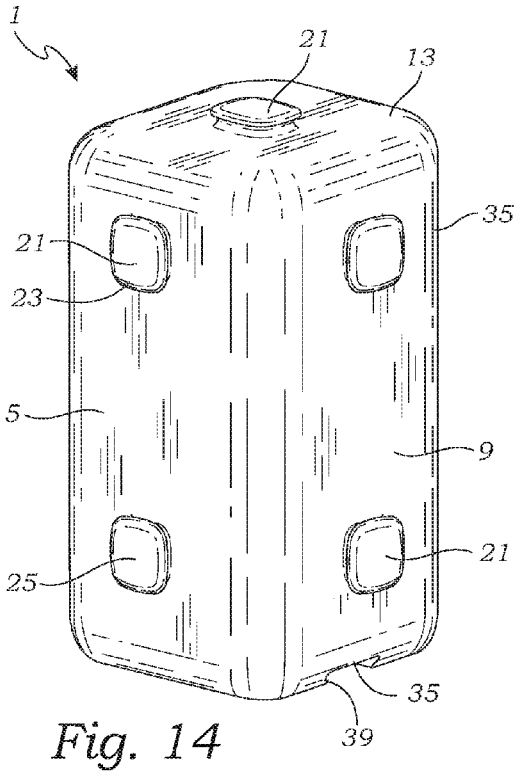
FIG. 14 is atop, front perspective view of a fifth embodiment of the stackable block of the present invention configured as a toy wherein two projections are formed on adjacent sidewalls, two slots are formed into adjacent sidewalls, a single projection projects from the top side, and a single slot is formed into the bottom side.
Figure 15:
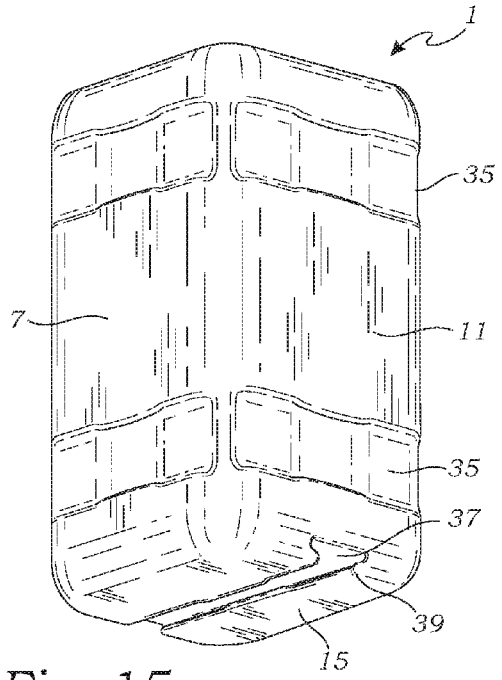
FIG. 15 is a bottom, rear perspective view of the stackable block of FIG. 14.
Figure 16:
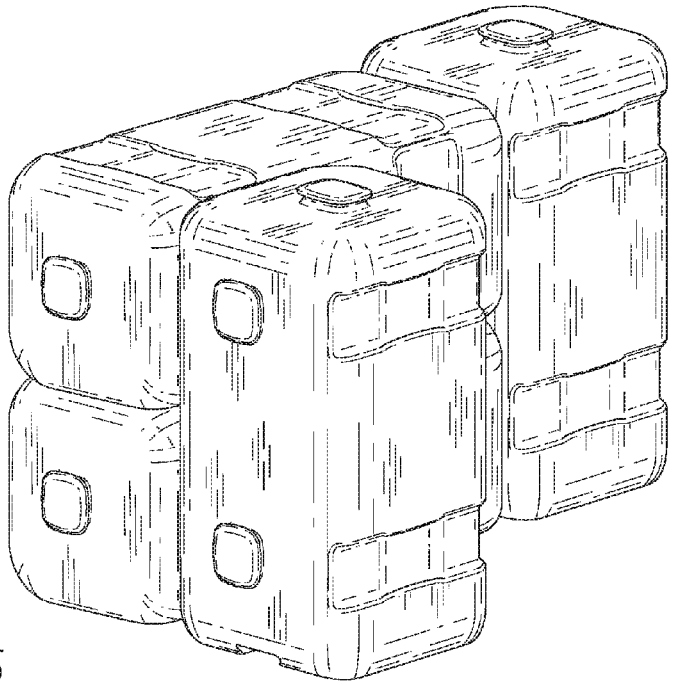
FIG. 16 is perspective view illustrating four stackable blocks of the type illustrated in FIGS. 14 and 15 stacked together.
Figure 17:
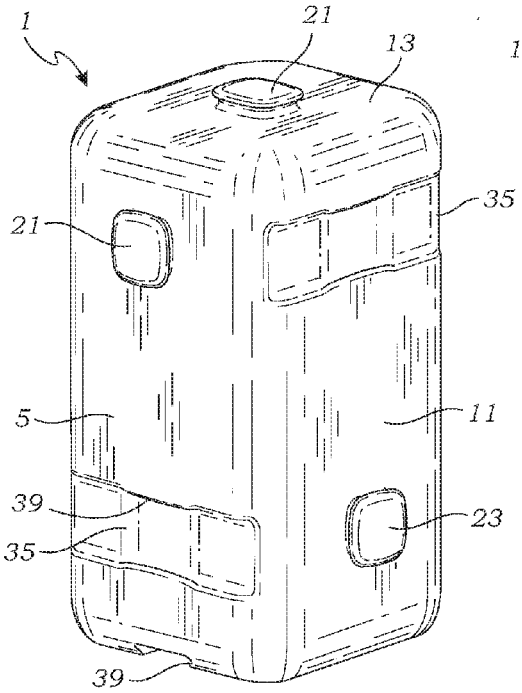
FIG. 17 is atop, front perspective view of a sixth embodiment of the stackable block of the present invention configured as a toy wherein four sides include a single projection and single slot, the top includes a single projection, and the bottom includes a single slot.
Figure 18:
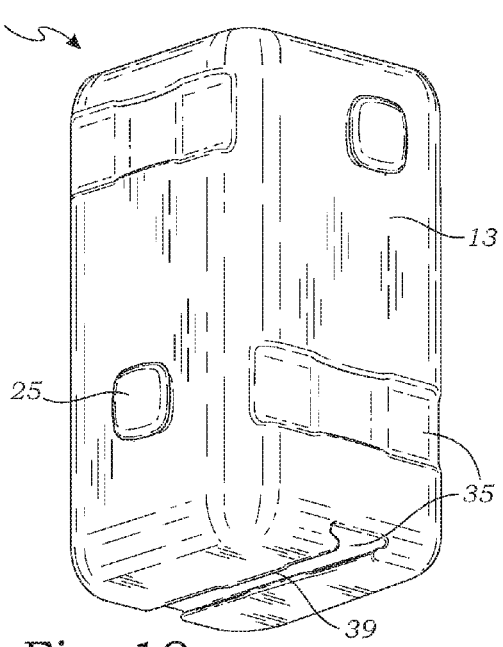
FIG. 18 is a bottom, rear perspective view of the stackable block illustrated in FIG. 17.
Figure 19:
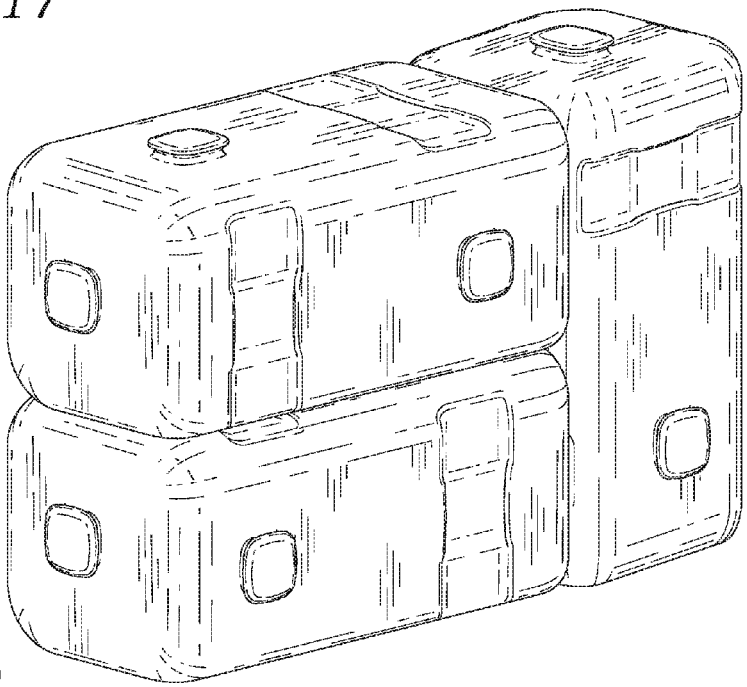
FIG. 19 is a perspective view illustrating three stackable blocks of the type illustrated in FIGS. 17 and 18 stacked together.
Figure 20:
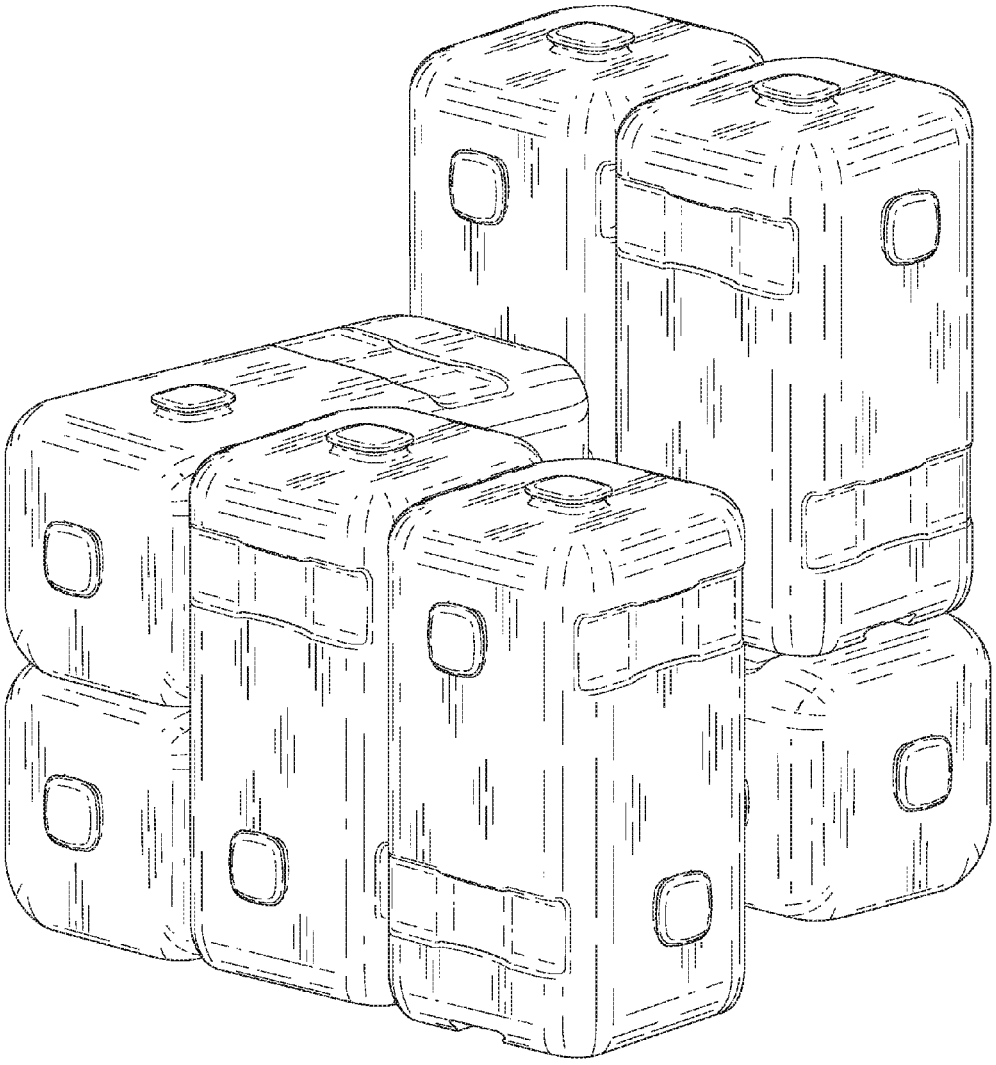
FIG. 20 is a perspective view illustrating seven stackable blocks of the type illustrated in the FIGS. 17 and 18 stacked together.

Meanwhile, FIGS. 11-20 illustrate stackable block embodiments for use as traditional toys, but not as beverage containers. In an embodiment illustrated in FIGS. 11-13, the stackable block includes a pair of projections 21 projecting from the opposing front side 5 and back side 7. Conversely, the block's left 11 and right side 9 are formed to include slots 35. Meanwhile, the block's top 13 includes a single projection and the block's bottom 15 includes a single slot 35. FIGS. 14-16 illustrate a similar stackable toy block 1. However, instead of the pair of projections 21 projecting from opposing sidewalls and the pair of slots formed into opposing sidewalls, the two pairs of projections project from adjoining sidewalls (illustrated as front side and right side), and the two pairs of slots 35 are formed into adjoining sidewalls (illustrated as back side 7 and left side 9).

Finally, FIGS. 17-20 illustrate still an additional stackable block 1 of the present invention. For this embodiment, the front side 5, back side 7, left side 9, and right side 11 include a single square projection 21 and a single slot 35. Whether the projection or slot is closer to the top side 13 or bottom side 15 is alternated in adjacent sides. Furthermore, the top includes a single square projection 21 and the bottom side 15 includes a single slot 35.

While several particular forms of the invention have been illustrated and described, it will be apparent that various modifications can be made without departing from the spirit and scope of the invention. For example, each of the preferred embodiments includes a block having a side with two square projections and another side having two parallel slots. However, equally preferred embodiments may include only a single square projection or a single slot. Alternatively, the slots may be arranged to extend perpendicular to one another, as opposed to parallel. Moreover, stackable blocks may include sides having three or more projections, or three or more slots which, again, may be parallel or perpendicular to one another. Since the present invention encompasses numerous embodiments not described or illustrated, the present disclosure is not intended to limit the invention to be limited except by the following claims. Having described my invention in such terms so as to enable persons skilled in the art to understand the invention, recreate the invention and practice it, and having presently identified the presently preferred embodiments thereof,

I claim:

1. A stackable block comprising:

a body having six sides including parallel opposing front and back sides, parallel opposing left and right sides, and parallel opposing top and bottom sides;

at least one square projection projecting from at least one of said sides, said square projection having a face and four sidewalls so that said square projection has a square cross-section, said square projection's face includes an edge which extends uniformly beyond all four of the square projection's four sidewalls to form a recess between said edge and said adjacent block side so that recess is formed into all four sidewalls;

at least one rectangular slot having a length and a width and wherein said rectangular slot is formed into one of said body's sides, said rectangular slot's length greater than said rectangular slot's width with said rectangular slot's width extending the entirety of said body's side to form a rectangular cavity that extends from one side of said body to an opposing side of said body, said rectangular slot also including opposed flanges that extend over the cavity with the distance between said flanges defining said rectangular slot's width, said rectangular slot being rectangular wherein said rectangular slot's length is greater than said rectangular slot's width; and said rectangular slot's width sized to receive a square projection of other like stackable blocks in two different press-fit attachment positions wherein said square projection and said rectangular slot's width are sized and configured so that said square projection can affix to a rectangular slot of other like stackable blocks in a first attachment position, and so that said square projection can affix to a rectangular slot of other like stackable blocks in a second attachment position wherein said square projection is rotated 90° as compared to the first position, and wherein said square projection's square edge and said rectangular slot's flanges being sized so as prevent said square projection from disengaging from a rectangular slot of other like stackable blocks when affixed in either the first or second attachment positions.

2. The stackable block of claim 1 wherein said block comprises at least two rectangular slots wherein a first of said rectangular slots is formed into a first side, and a second of said rectangular slots is formed into a second side adjacent to said first side.

3. The stackable block of claim 1 wherein said block includes a first side having at least two of said square projections, a second side having at least two of said rectangular slots, and a third side adjoining said second side having at least one rectangular slot.

4. The stackable block of claim 1 wherein said block is constructed as a beverage container including a central cavity, a beverage in said central cavity, an opening formed into said top side, and a removable cap covering said opening.

* * * * *